US005365615A

United States Patent [19]

Piszkin

[11] Patent Number: 5,365,615

[45] Date of Patent: Nov. 22, 1994

[54] HEADGEAR FACESHIELD W/NON-INVASIVE UNIVERSAL-MOUNTING

[76] Inventor: Thomas M. Piszkin, 11089 Turret Dr., San Diego, Calif. 92131

[21] Appl. No.: 3,288

[22] Filed: Jan. 12, 1993

[51] Int. Cl.[5] ..... A42B 1/24

[52] U.S. Cl. ..... 2/422; 2/424; 2/10; 2/12

[58] Field of Search ..... 2/422, 424, 425, 410, 2/15, 10, 12, 9, 185 R, 199

[56] References Cited

U.S. PATENT DOCUMENTS

| | | | |
|---|---|---|---|
| 3,239,842 | 3/1966 | Marchello | 2/422 |
| 3,594,816 | 7/1971 | Webb | 2/10 |
| 4,047,249 | 9/1977 | Booth | 2/10 |
| 4,097,930 | 7/1978 | Bay | 2/10 |
| 4,117,553 | 10/1978 | Bay | 2/10 |
| 4,462,119 | 7/1984 | Rudd | 2/424 |
| 4,495,657 | 1/1985 | Bay | 2/425 |
| 4,625,341 | 12/1986 | Broersma | 2/424 |
| 4,744,107 | 5/1988 | Fohl | 2/422 |
| 4,920,576 | 5/1990 | Landis | 2/9 |
| 4,947,490 | 8/1990 | Hayden | 2/425 |

FOREIGN PATENT DOCUMENTS

| | | | |
|---|---|---|---|
| 2508777 | 1/1983 | France | 2/410 |

*Primary Examiner*—Clifford D. Crowder
*Assistant Examiner*—Michael A. Neas

[57] ABSTRACT

An aerodynamically configured face-shield suitable for sports-helmets or other similar head protective gear, which is inexpensively die-cut and readily conforming to the frontal vertical-brim region of an existing visorless-helmet via special mounting elements. The vestigial low-profile mounting-elements are non-intrusive, and permanently install via double-face mounting-tape, as extruded-plastic strips having elongated-bifurcations which are manually swedged into corresponding die-cut attachment-slots at opposite lateral sides of the helmet brim. Thus attached, the special faceshield is held rigidly in position against physical forces such as are encountered during bicycling; yet, may be instantly avulsedly detatched by the user merely pulling the faceshield away from the brim mount-strips. This unique mounting methodology virtually eliminates potentially injurious fasteners heretofore employed in faceshield hardware design; plus, it presents an aerodynamically superior conformation.

11 Claims, 1 Drawing Sheet

HEADGEAR FACESHIELD W/NON-INVASIVE UNIVERSAL-MOUNTING

PROBLEMATICAL BACKGROUND OF RELEVANT EARLIER INVENTION

This invention relates to transverse wrap-around/die-cut transparent faceshields for protective headgear; and more specifically, it relates to those types of faceshields employing attachment/detachment means which is essentially non-invasive of the helmet brim structure per'se; plus, in consideration of brim-mounted sunvisors as well.

Heretofore, it has been popular, particularly among the volume-selling bicycling type of protective-headgear, to produce helmets which are generally worn remiss of any sort of faceshield covering the upper-half of the cyclist's face; although in some cases snap-on brim-visors have been widely employed. This is essentially due to the cyclist's is pageant for elimiating anything imposing a weight penalty or air-drag; and, partly because much of a cyclist's travel is often at modest road-speeds essentially obviating critical need for eye-protection. However, since the wearing of a regulation cycling-helmet of some type is now deemed mandatory in most states, cyclist's are becoming more accustomed to the vitiations of their sport, while realizing that the roadways are growing so clogged with motorcars that additional protection from the elements of road-splash makes the notion of wearing a semi-faceshield (upper face only) at least sensible. Plus, out on the open road, particularly at speed, a properly configured faceshield can significantly improve visual-safety and cycling aerodynamics.

Background research discovery provides some prior patent-art regarded as merely germane to this disclosure, for example U.S. Pat. No. 190 3,594,816 (filed—December, 1969) shows a radiused face-shield of the wrap-around type, which is pivotally mounted at both lateral sides of the attendant helmet-shell, so that the faceshield may be swung overhead, or may be avulsed away entirely with one hand if desired. The faceshield includes a perimeter-band having three horizontal female-snap portions, which snap upon the three male/snap-retainers existing on certain brands of motorcycle-helmets for example. The plastic-band has an elastic-band (kept in position by the edge-beading found on certain safety-helmets) portion extending around the rear of the helmet, which improves retention-tension against the said forward snap triad. However, the use of such rivet-like positioning-snaps on safety-helmets is now receiving growing resistance, in as much as they pose a potential source of point-pressure injury (intrusion to the forehead) in event of impact-accident. Then U.S. Pat. No. 4,047,249 (filed—December, 1975) provided for the addition of an inner-faceshield to a racecar driver's type of safety-helmet normally having only two pivot-mountings situated approximately adjacent to the top of the ear-pocket region. The additional faceshield however, being merely snap-fastened inside of this existing faceshield, at the lower left/right sides thereto. Other than showing a die-cut faceshield member having two (extreme upper right/left) slotted (female) retainer/pivot holes, nothing is exhibited here which would actually be anticipated as safely adaptable to bicycle-helmet designs for example.

Next, U.S. Pat No. 4,097,930 (filed—March, 1977) shows a necessarily injection-molded avulsable faceshield (believed for a motorcyclist's safety-helmet) again employing the once popular triad of male/snap-fasteners(utilizing the center one only actually) acres the helmet's forehead region. Also provided, is a special tight-cluster of three to five integrally-molded female/-snap-fasteners at both extreme right/left lateral ends of the wrap-around configuration; which are said so formed, as to tightly adapt to a premounted male/snap-fastener how so ever prolocated at said opposed sides. However, the currently popular shapes of bicycling-helmets do not feature lateral facial-protection extending so far down to the user's jaw region, as is supposed by the earlier embodiment of this invention.

The special die-cut wraparound plastic faceshield of U.S. Pat. No. 4,462,119 (filed—September, 1981) features a top and bottom centered indexing-tab arrangement, which flexibly index into horizontal receiver-slots formed into a secondary frame adapting the faceshield to an early standard safety-helmet. Of particular interest however, is use of special elastic tension-cords at the extreme right/left lateral corners of the faceshield; the cords simply looping into a hole at the said corners, so as to be readily looped around a tie-down stanchion situated slightly further around the right/left helmet sides. Although the faceshield may be readily avulsed by the user, the presence of the rivet-like stanchions, makes safe adaptability of the hardward to modern bicycling safety-helmets, of question.

Then U.S. Pat. No. 4,495,657 (filed—September, 1982) set forth an injection-molded faceshield of predetermined wrap-around contouring, which also apparently attempts to utilize the once popular triad of male-snaps spaced across the helmet's forehead-brim region; although actually utilizing only the center snap member, via an integrally-molded female-snap formation. Of particular interest here, is the manner in which the top-center plus two additional side retention provisions are formed as elongated-slots, each slot having tiny secondary opposed elongated-lips molded therewith. These slots are actually formed occluded, that is, they have a raised cap-like covering on their outside, while their inside portion carries the said elongated-lips along a female-slot like recess; -the lips being designed to resiliently engage over otherwise substantially conventional male-snaps provided upon the helmet exterior. The advantage of this described elongated-lip/slot arrangement being said to enable the faceshield to accomodate a wide divergence of male/snap-fasteners found upon different makes of safety-helmets.

Lastly, reference to U.S. Pat. No. 4,625,341 (filed—July, 1985) shows a motorcyclists-helmet having a die-cut wrap-around faceshield, made in combination with a secondary visor-like brim-band, enabling the aggregation to be pivoted conveniently overhead. The faceshield includes a plurality of vertical tongue-like bifurcated male-tabs, allowing the faceshield to be avulsed from the visor portion via a sliding action if desired; while having eliminated the intrusion of separate and possibly injurious fasteners. However, the added presence of the visor-member is objected to by bicycling cyclist's, since it tends to make the combined helmet aggregation too heavy. Moreover, since a bicyclist's head is typically set at a more downward facing attitude, there is no need to outset the faceshield from the helmet brim in order to gain clearance, even for the more protruding of bicyclist's noses. A more downward head attitude, also normally negates wind catching beneath the faceshield.

Accordingly, the instant inventor hereof has developed a specialized sports-helmet, ideally oriented toward the bicylist's needs; being introduced as the AiroShield TM -product, produced under auspices of AIROSHIELD-Mfg./Mkt.Company, San Diego, Calif.

SUMMARY OF THE INVENTION

A.) In view of the foregoing discussion about the earlier invention art, it is therefore important to make it pellucid to others interested in the art, that the object of this invention is to provide a light-weight one-piece die-cut flexible plastic faceshield; which may be readily detached from a safety-helmet, via single-handed avulsing action, without appreciable degradation of secure fastening tautness over prolonged usage.

B.) Another contemplation of this disclosure, is to provide a sports or utility helmet faceshield or sun-visor capable of being easily retro-fitted as an aftermarket addition to an existing sports-helmet; and importantly, involving no hardware capable of imposing some manner of potentially injurious intrusion relative to the helmet-body. This is achieved via provision of two simple die-cut precision retention-slots positioned horizontally along the upper edge, and opposite lateral-ends of the faceshield; the retention-slots being employed virtually independent of any pre-existing helmet fastener-means, thereby assuring maximum installation integrity, particularity in the manner of retention tautness. Working in cooperation with each female/retention-slot, is a simple extruded-plastic male retention-strip having resilient bifurcated-lips carefully formed as to readily insert into their faceshield retention-slots. Since most bicycling helmets do not have provision for a protective faceshield, the extruded retention-strips are preferably each provided with a backing of 3M®-corp's. superior Scotch®/VHB type double-face/adhesive-tape (non-foam type, temporarily covered with a removable protective-strip). Accordingly, in retrofit (non-factory) installations, the public is generally instructed to snap the aggregate retention pieces together into the faceshield, then carefully determine centered alignment upon the helmet's frontal-brim region (first cleaning the region with isopropyl-alchol or heptane) of their sport-helmet, remove the protective-strips, and with deft firmness apply the faceshield there into desired mounting-position. Although installation is thus completed, 3M-corp. recommends the faceshield be at once detached, leaving the retention-strips alone in-place 72-hours (at 70°-degrees), for ultimate bond-strength. Alternately, while 3M's/Scotch foam-tape seems suitable, it tends to delaminate as to peel-strength. However, except for safety-helmets made of EPS (expanded-polystryne-plastic, direct chemical-bonding is practical via the more instant acting joiners such as Cyanoacrylate (such as CrazyGlue®) may be preferred.

C.) Another object of this invention, is to provide a sports-helmet faceshield lens-body made from a simple inexpensive, light-weight, transparent, preferably die-cut approximately 0.020-inch gauge flexible polycarbonate-plastic sheet material, which preferred length of 11-inches can be manually rolled into a tightly coiled cylindrical-shape (approximately the diameter of a common quarter or nickel coin), kept inside of a Velcro® (hook & loop fastener) RollPak TM holding-band, and thereby easily carried in one's shirt or pants pocket until needed. Since the AiroShield® is being offered in both clear, tinted, and Polaroid (anti-glare) versions, the convenient RollPak TM modality actually enables the user to carry more than one type of faceshield if desired; perhaps switching lenses according to the time of day(-combating sun, or headlight glare condition variances for example).

An alternate hi-speed 0.030-inch/gauge faceshield lens-body is also being provided, as more suitable where speeds in the range of 65 mph are anticipated. This embodiment being actually oven-heat/drape-formed over an approximate 3½-inch radius, which does not alter the fine optical quality, but serves to eliminate the initial brim-bend "preload-tension" condition otherwise naturally exerted upon the two helmet brim/retention-fasteners. It has been found, that by simply eliminating brim/proload-tension, a lens of only slightly thicker-gauge will take substantially greater aerodynamic-stress without exhibiting a possibly dislodging resonate-frequency vibration; thereby utilizing the same retention-fasteners as the lighter-weight alternative. While the thicker-gauge appears the same installed on a helmet, it unfortunately does not lend itself to as compact a coiling-diameter preferred in the RollPak TM modality, it nevertheless enables hi-speed usage if desired (albeit at a slightly higher sales-price, owing to the additional labor involved).

D.) Another object of this invention, is to provide a safety-helmet faceshield certified compatibly in compliance with ANSI's(Amer. Nat. Standards Institute) safety-standard: Z-90.4/'84 for the host-helmet. Although it is intended that the AiroShield TM be adapted to various headgear applications, including that of recreational skating, skiing, hockey, mountain-climbing, etc.; where it is desirable to present a more aerodynamic airflow around a helmet, reduce glare to eyes, or generally protect the upper-face region, while still wearing corrective-glasses if desired. Since AiroShield TM is considered practical at speeds to around 35 mph, important provision in the preferred form of an airflow-slot situated at the top-center of the faceshield, serves to obviate presence of lens-fogging; -often plaguingly associated with faceshields. Note also, comparison to face-goggles shows goggles tend to collect brow-flow perspiration, which can dangerously distort one's vision.

Furthermore, AiroShield TM is optically nonaberrant, that is to say, it's evenly curvilinear radiused (installed) configuration and general light-transmission characteristics are not distortive of one's natural field-of-vision. Moreover, the special universally attachable/detatchable faceshield mounting members set forth in this disclosure clearly satisfy ANSI's safety-regulation Standards-section: 4.2, so stating- "there shall be no permanent external projection greater than 5 mm above the outer-surface of the helmet-shell. Rivet-heads shall be radiused, and shall not project more than 2 mm about the outer-surface of the helmet-shell . . . ". In summation, it is believed the above itemized criteria have heretofore represented a most daunting impediment to the successful implementation of a viable aftermarket helmet faceshield. Plus, by the simple expedient of adding a pair of inexpensive male/retention-strips to one's secondary (back-up) helmet, or other different catagory of safety-helmet, this new faceshield is ready to serve it's user well, if pragmatically in a variety of ways.

E.) Additionally, it is perhaps prudent here to briefly list the general objects involved in developing the AiroShield TM invention:

a.) to provide a faceshield particularly compatible with a majority of known sports-helmets (particularly bicycling-helmets), having differing design-configurations;

b.) to be ultimately light-weight, and not affect wearer's natural head-carriage attitude;

c.) to not distort nor limit wearer's natural field-of-vision;

d.) to not detract from the host-helmet's existing ANSI-approval status;

e.) to be suitably human-engineered as to be readily attached/detached under varied environmental conditions;

f.) to be exceptionally impact and scratch resistant, and tolerate ultraviolet exposure;

g.) to facilitate optional mounting of a brim/sun-visor if desired;

h.) to provide some manner of convenient stow-modality during disuse;

i.) to be commercially viable, via attractive appearance and costing.

DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered as primarily exemplary and not to be therefore construed as restrictive in nature. Hence, FIG. 1, is a pictorial perspective-view favoring the frontal upper-left portion of a substantially conventional host sports-helmet, wherein is included the subject faceshield invention as installed in a normally functioning condition;

Figures 1, 2, 3, 4, 5, 6, 7, 8, 9, 10:
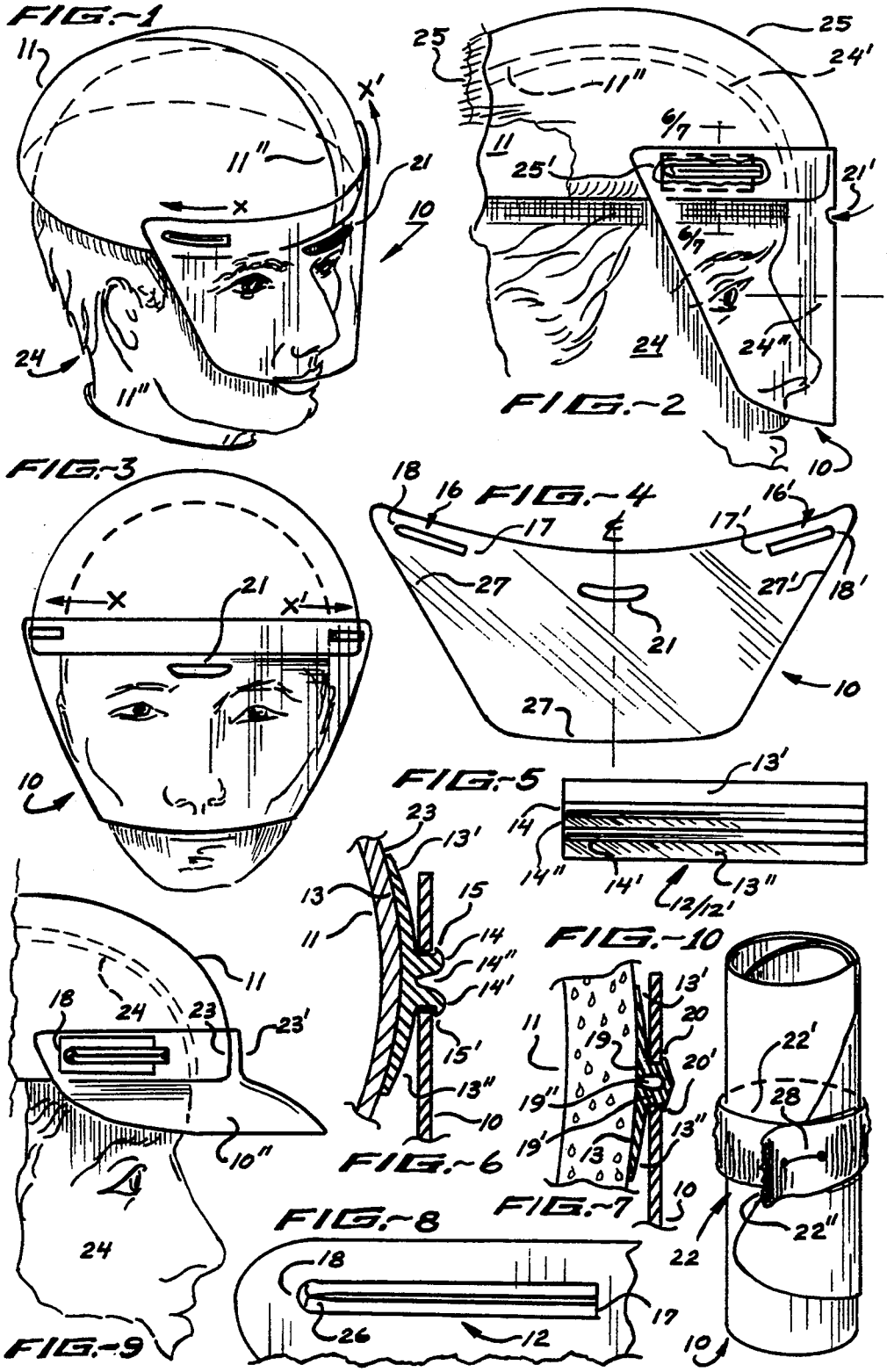
FIG. 2, is a 4× enlarged forward-portion side/elevation-view thereof, including partial cut-away of a covering, and phantom-outline of wearer's cranial region for spatial reference.
FIG. 3, is a reduced scale frontal/elevation-view thereof.
FIG. 4, is a full flat-pattern thereof.
FIG. 5, is a frontal/elevation-view of a component member.
FIG. 6, is a 4× cross-sectional view, as referenced 6:6 in FIG. 2.
FIG. 7, is an alternate generic variant thereof, as referenced 7:7 in FIG. 2.

FIG. 8, details the component part of FIG. 5 installed according to FIG. 2;

FIG. 9, is a frontal/elevation-view thereof, exemplifying a favorable generic-variant embodiment;

FIG. 10, is a side/elevation-view depicting an alternate stow-modality condition.

Quick-Reference Nomenclature

10/10',10''—faceshield lens-body natural/coiled condition, sunshield-body

11,11'—the host safety-helmet, helmet longitudinal center ref.-line, helmet underside

12/12'—male/retention-strip (identical, right/left)

13,13'/13''—brim application surface, outside upper/-lower flanges

14/14',14''—upper/lower bifurcated-lips, compression-space

15/15'—upper/lower minute snag-lip entities

16/16'—female/retention-slot (mirror-image right/left)

17/17'—squared inboard-ends (identical, right/left)

18/18'—rounded outboard-ends (identical, right/left)

19,19'/19''—alternate-type upper/lower bifurcated-lips, compression-space

20'—upper/lower large snag-ramps

21,21'—aerodynamic ventilation-slot, air-flow arrow

22,22'—hook & loop type holding-band

23,23'—vertical-rim portion of helmet, vertical-brim of sunvisor

24,24',24''—host wearer, wearer's cranial region, horizontal eye-sight ref.-line

25,25'/25''—fabric helmet covering, relief-openings(-right/left)

26—pinched-lip region

27/27',27''—extreme right/left faceshield edges, lower edge

28—button attachment-slot

DETAILED DESCRIPTION OF THE PREFERRED EMBODIMENTS

Initial reference is given by way of FIGS 1,2,3, wherein is exemplified a currently popular type of protective-headgear in the form of exemplified conventional bicyclist's helmet 11, shown equiped with a special preferably one-piece curvilinear faceshield lens-body 10, attached to the helmet by means of two low-profile linear retention-strips 12/12'. These special retention-strips are preferably spaced equidistant from longitudinal center reference-line 11'', and are either applied at the factory or may be retrofitted by the helmet owner.

The faceshield 10 may be readily avulsed from the resilient plastic retention-strips 12/12' by simply lifting either edge 27/27' of the faceshield outwardly away from the helmet-brim region 11', in an easy pealing action. Note in FIGS. 4,5,6, how the faceshield is provided with a slot like female/retention-slots 16/16' which is preferably diecut square at the inward facing ends 17/17' as shown in FIG. 4, while the outboard facing ends are preferably radiused 18/18'. Thus, the slot openings 16/16' are actually formed slightly narrower than the overall vertically spaced width of the bifurcated male/retention-strip lips 14/14', the arrangement thereby forcing the lips to become slightly squeezed together into the common compression-space 14'', causing the opposed lips to resiliently tension against the respective opposed linear edges of the retention slots 16/16'. Reference to FIG. 8 demonstrates how the square end 17 acts as an abutment against which the retention-lips 14/14' are restricted, thereby enabling the radiused end 18/18' of the respective retention-slots 16/16' to act in a pinching action 26 at the outward ends of the bifurcated-lips 14/14'.

Further study of FIGS. 1&2 shows reference-arrows X/X' which represent a preferred band-tensioning action, acting to bias the outward ends of the bifurcated-lips into the pinching effect imposed by the narrowing of radiused ends 18/18'; thereby increasing the ultimate retention action of the aggregation. This increased holding ability is particularly important when a frontal wind exceeds about 28-mph, whereas below that velocity no retention weakness has been detected. It should be noted also, that a Mk.-II version of the faceshield is made of a 50%-thicker gauge of flexible plastic, which is actually drape-formed to a curvilinear shape substantially like that represented by the helmet leading edge contour shown in FIG. 1; thereby significantly improving resistance against becoming avulsed by wind or inadvertant impact.

An alternate configuration to the fully bifurcated retention-strip embodiment of FIG. 6 is set forth in FIG. 7, wherein a similar compression-space 19'' enables the reversed bifurcations 19/19' to receed slightly into the space 19'' when instrted into the same respective retention-slots 16/16'. Note here also that an outermost entry portion is formed with opposed snag-ramps 20/20' which are similarly provided as snag-lips 15/15' in the preferred embodiment of FIG. 6. Regardless as to the formation of the bifurcations, the retention-strip is permanently mounted upon the rim surface 23 of the helmet, either with a high-strength double-face tape along surface 13, or via use of a suitable chemical-bonding agent along the same interfacing surfaces.

Note also in FIG. 5, how the non-invasively bonded male/retention-strip profiles of FIGS. 6&7 appear very elongated or linear in frontal plan-view, distinguishing them well apart in holding ability from the prior-art.

In FIG. 9 there is shown an alternate generic-variant embodiment of the invention in the form of a sunvisor member 10'', which enables the user to conveniently switch from use of the faceshield 10 if desired; simply by avulsing the faceshield and applying the sunvisor instead. Once thus removed, the sunvisor may be conveniently carried in one's pocket merely by rolling-up the flexible planar faceshield 10 of FIG. 4 into a tightly coiled modality as is illustrated in FIG. 10. Note here, that a conventional strip of Velcro TM hook 22' and loop 22'' material may be expediently fashioned into a suitable holding-band 22. When not in use, the Velcro-fastener may be conveniently slipped over an existing button on one's clothing via provision of a simple convenience-slot 28 included upon the holding-band if desired. Accordingly, the faceshield may also be carried this way even if one's apparel has no pockets in which to avail the carrying. Moreover, it can be readily understood that by replicating the mounting of identical retention-strips upon yet another headgear unit, one may avail one's self of a secondary application, without the expense of a second faceshield or sunshield.

Therefore, it is understood that the utility of the foregoing adaptations of this invention are not necessarily dependent upon any prevailing invention patent; and while the present invention has been well described hereinbefore by way of preferred embodiments, it is to be realized that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation. Accordingly, the embodiments of the invention in which an exclusive property or proprietary privilege is claimed, are defined as follows.

What is claimed of proprietary inventive origin is:

1. A plastic faceshield system, universally adapted to conventional protective headgear of the type having a transverse frontal rim potion capable of receiving non-invasive appliance members, comprising:

two transversely spaced horizontally elongate male/retention-strips, each made of resilient material and formed with an outward projecting bifurcated lip-like engaging means, said lip-like engaging means having a vertically measured width, mounting means provided on said male/retention-strips for permanently attaching said male/retention-strips to said protective headgear rim portion, said strips being arranged equidistant from the longitudinal center of said headgear when attached to said rim portion;

a transparent flexible nonaberrant lens body, said lens body including two transversely spaced horizontally elongate female/retention-slots located proximal to extreme lateral outer margins of said lens body and adapted to receive said engaging means, said slots being formed slightly narrower than the vertically measured width of said lip-like engaging means, causing said lip-like engaging means to resiliently tension against respective opposed linear edges of said female/retention-slots, thereby facilitating convenient manually swaged attachment and conversely manually avulsed detachment relative to said male/retention-strip lip-like engaging means;

and said female/retention-slots being square-cut at their inboard facing ends and round-cut at their outboard facing ends.

2. A plastic faceshield system according to claim 1, wherein said lens body is curvilinear and die-cut from high impact plastic material.

3. A plastic faceshield system according to claim 1, wherein said male/retention-strips are made of extruded plastic.

4. A plastic faceshield system according to claim 1, wherein said mounting means comprises a substantially flat flange-like portion on the male/retention-strips, a back side of the flange-like portion providing a broad surface area for bonding to said headgear's frontal rim portion.

5. A plastic faceshield system according to claim 1, wherein each bifurcated lip-like engaging means includes minute snag lips serving to secondarily aid in the mechanical engagement between the male/retention-strips and the female/retention-slots.

6. A plastic faceshield system according to claim 1, further comprising a holding band, said holding band securing said lens body in a tightly coiled position when said lens body is not mounted to said headgear.

7. A plastic sunshield system, universally adapted to conventional protective headgear of the type having a transverse frontal rim potion capable of receiving non-invasive appliance members, comprising:

two transversely spaced horizontally elongate male/retention-strips, each made of resilient material and formed with an outward projecting bifurcated lip-like engaging means, said lip-like engaging means having a vertically measured width, mounting means provided on said male/retention-strips for permanently attaching said male/retention-strips to said protective headgear rim portion, said strips being arranged equidistant from the longitudinal center of said headgear when attached to said rim portion;

a sunvisor body including two transversely spaced horizontally elongate female/retention-slots located proximal to extreme lateral outer margins of said lens body and adapted to receive said engaging means, said slots being formed slightly narrower than the vertically measured width of said lip-like engaging means, causing said lip-like engaging means to resiliently tension against respective opposed linear edges of said female/retention-slots, thereby facilitating convenient manually swaged attachment and conversely manually avulsed detachment relative to said male/retention-strip lip-like engaging means;

and said female/retention-slots being square-cut at their inboard facing ends and round-cut at their outboard facing ends.

8. A plastic sunshield system according to claim 7, wherein said sunvisor body is made of resilient, high impact plastic.

9. A plastic sunshield system according to claim 7, wherein said male/retention-strips are made of extruded plastic.

10. A plastic sunshield system according to claim 7, wherein said mounting means comprises a substantially flat flange-like portion on the male/retention-strips, a back side of the flange-like portion providing a broad surface area for bonding to said headgear's frontal rim portion.

11. A plastic sunshield system according to claim 7, wherein each bifurcated lip-like engaging means includes minute snag lips serving to secondarily aid in the mechanical engagement between the male/retention-strips and the female/retention-slots.

* * * * *